United States Patent [19]

Steinke

[11] 4,352,529

[45] Oct. 5, 1982

[54] DRAWER LOCKING SYSTEM

[75] Inventor: Mark H. Steinke, Montgomery, Ill.

[73] Assignee: Lyon Metal Products, Incorporated, Aurora, Ill.

[21] Appl. No.: 203,123

[22] Filed: Nov. 3, 1980

[51] Int. Cl.[3] ..... E05B 65/46; E05C 7/06

[52] U.S. Cl. ..... 312/222; 312/219; 312/221; 312/107.5

[58] Field of Search ..... 312/222, 221, 219, 218, 312/217, 216, 215, 107.5, 333

[56] References Cited

U.S. PATENT DOCUMENTS

| | | | |
|---|---|---|---|
| 1,036,442 | 8/1912 | Bullock | 312/107.5 |
| 2,501,932 | 3/1950 | Budai et al. | |
| 2,835,547 | 5/1958 | Erismann | 312/219 |
| 2,992,056 | 7/1961 | Thielker | 312/221 |
| 3,023,066 | 2/1962 | Mohr et al. | 312/219 |
| 3,291,547 | 12/1966 | Foster . | |
| 3,374,043 | 3/1968 | Lewin | 312/219 |
| 3,589,783 | 6/1971 | Studinski et al. | 312/217 |
| 3,598,462 | 8/1971 | Kanitz | 312/219 |
| 3,791,708 | 2/1974 | Signore | 312/221 |
| 3,936,108 | 2/1976 | Chitester | 312/217 |
| 3,941,441 | 3/1976 | Scheerhorn | 312/215 |
| 4,066,308 | 1/1978 | Wedel | 312/219 |

*Primary Examiner*—Victor N. Sakran

*Attorney, Agent, or Firm*—Dithmar, Stotland, Stratman & Levy

[57] ABSTRACT

The system includes an elongated latching bar located behind the drawers and rotatable between latching and unlatching positions. A spring biases the latching bar to its latching position. A latching clip is mounted on each drawer and has a cam for engaging the latching bar and causing rotation thereof to its unlatching position as the drawer is closed. The latching clip has a keeper for receiving the latching bar as it rotates back to its latching position.

24 Claims, 9 Drawing Figures

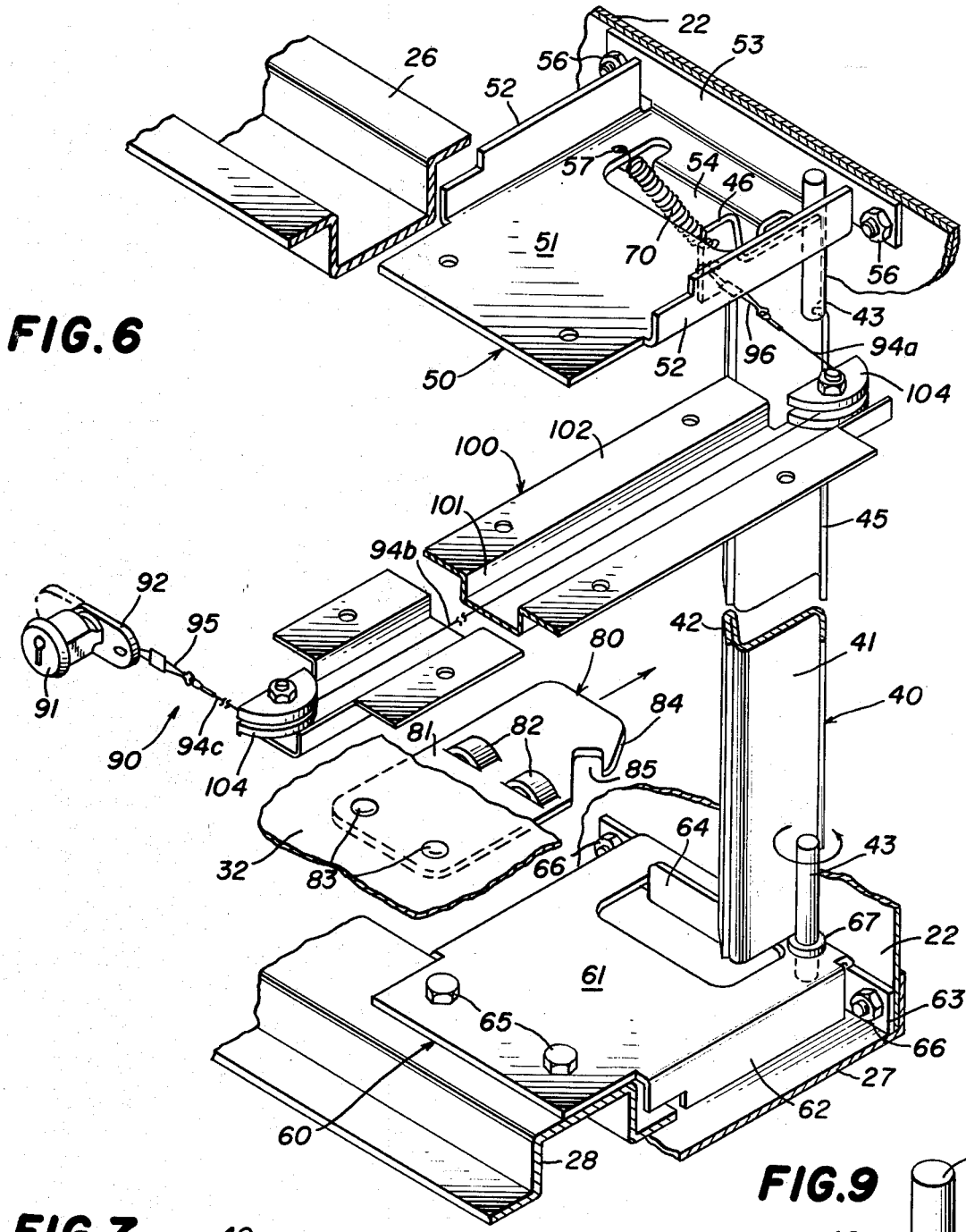
FIG. 6
FIG. 7
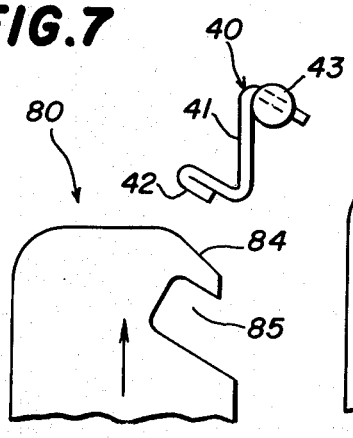
FIG. 8
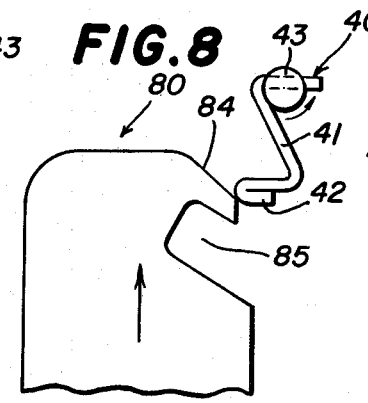
FIG. 9
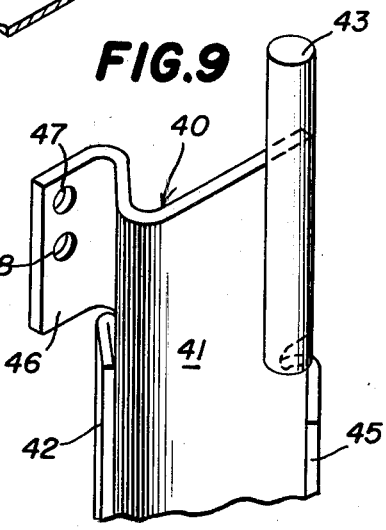

DRAWER LOCKING SYSTEM

BACKGROUND OF THE INVENTION

Cabinets with currently available single-lock drawer locking systems are such that, when locked, all of the drawers in the cabinet are locked and cannot be opened. When the lock is unlocked, all of the drawers can be opened or closed as desired. There are situations in which it is desirable that one or more of the drawers in the cabinet be opened while the rest of the drawers remain locked. Presently available locking systems do not accommodate such an operation. Furthermore, present systems do not enable the open drawers later to be closed and automatically locked without requiring a key. Another shortcoming of present systems is they must be tailored to the drawer configuration. If drawers of different heights are to be used in the same cabinet enclosure, the locking system must be suitably modified. Drawers are also used in shelving systems. Presently available locking systems have not been altogether satisfactory in being useable in that kind of installation in addition to being useable in a cabinet.

SUMMARY OF THE INVENTION

It is therefore an important object of the present invention to provide a drawer locking system in which some of the drawers may be closed and locked while others of the drawers are open.

In connection with the foregoing object, it is another object to provide a drawer locking system in which the open drawers can thereafter be closed and automatically locked without the use of a key. Another object is to provide a drawer locking system which can accommodate drawers of various heights without modification.

Another object is to provide an improved drawer locking system which is capable of use not only in cabinets but also in shelving systems.

In summary, there is provided a drawer locking system for use with a frame having a front, a rear, a pair of sides and upper and lower ends, and at least two drawers carried by the frame and movable between a forwardly open position and a rearwardly closed position, the drawer locking system comprising an elongated latching bar having a longitudinal axis substantially perpendicular to the ends of the frame and extending adjacent to the drawers, the latching bar being rotatable about the longitudinal axis between latching and unlatching positions, means for biasing the latching bar to the latching position thereof, and a latching clip on each of the drawers and having camming means for engaging the latching bar and causing rotation thereof to the unlatching position thereof as the associated drawer is moved toward the closed position thereof, whereupon the associated drawer can be moved further toward the closed position until the camming means passes the latching bar, whereupon the latching bar tends toward the latching position thereof, the latching clip further having keeper means for receiving the latching bar as it rotates toward the latching position thereof.

Further features of the invention pertain to the particular arrangement of the parts of the drawer locking system, whereby the above-outlined and additional operating features thereof are attained.

The invention, both as to its organization and method of operation, together with further objects and advantages thereof will best be understood by reference to the following specification taken in connection with the accompanying drawings.

BRIEF DESCRIPTION OF THE DRAWINGS

FIG. 6 is a perspective view of the drawer locking system and its relationship to some of the parts of the cabinet;

FIG. 7 is a view of the latching clip and latching bar with the corresponding drawer open;

FIG. 8 is a view like FIG. 7 but with the locking bar being rotated preparatory to the drawer being moved to its closed position; and FIG. 9 is a fragmentary, perspective view of the top end of the latching bar.

DESCRIPTION OF THE PREFERRED EMBODIMENTS

Figure 1:
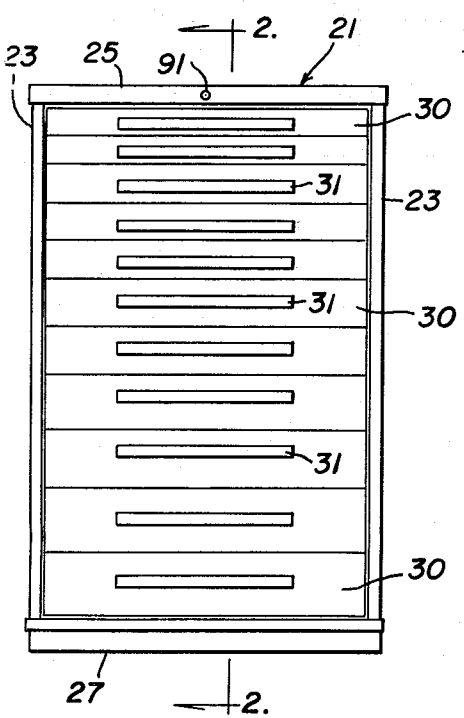
FIG. 1 is a front elevation view of a cabinet incorporating the drawer locking system of the present invention.

Referring now to the drawings, and particularly to FIG. 1 thereof, there is illustrated a cabinet 20 made in accordance with and embodying the principles of the present invention. The cabinet 20 includes a case 21 having a substantially rectangular rear wall 22 and a pair of substantially rectangular side walls 23 extending forwardly therefrom and disposed substantially perpendicular thereto and parallel to each other. The case 21 further includes a top 25 and a base 27. Eleven drawers 30 are disposed in the case 21, each being provided with a pull 31.

Figure 2:
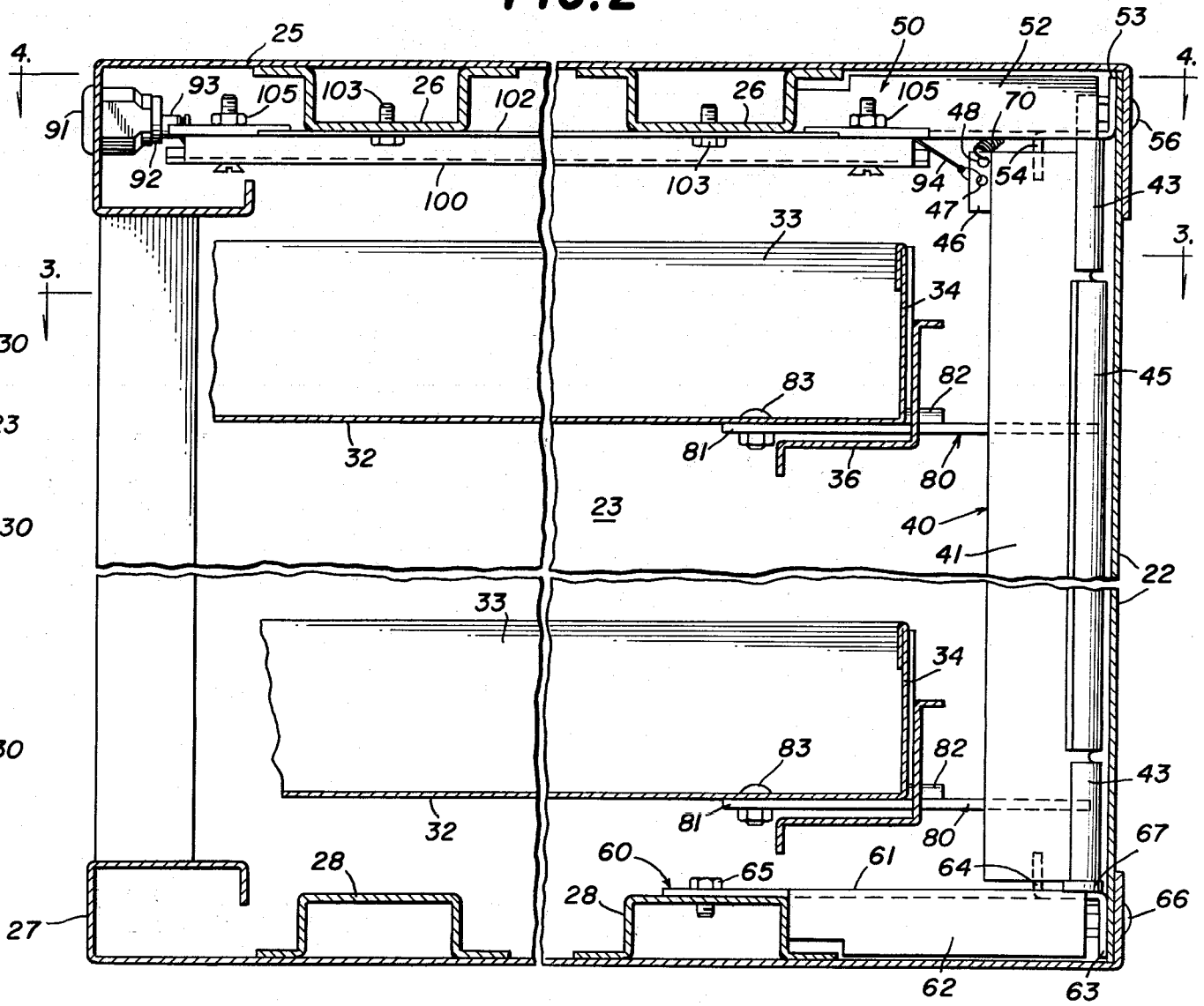
FIG. 2 is a fragmentary view in vertical cross section taken along the line 2—2 of FIG. 1, on a greatly enlarged scale.
Figure 3:
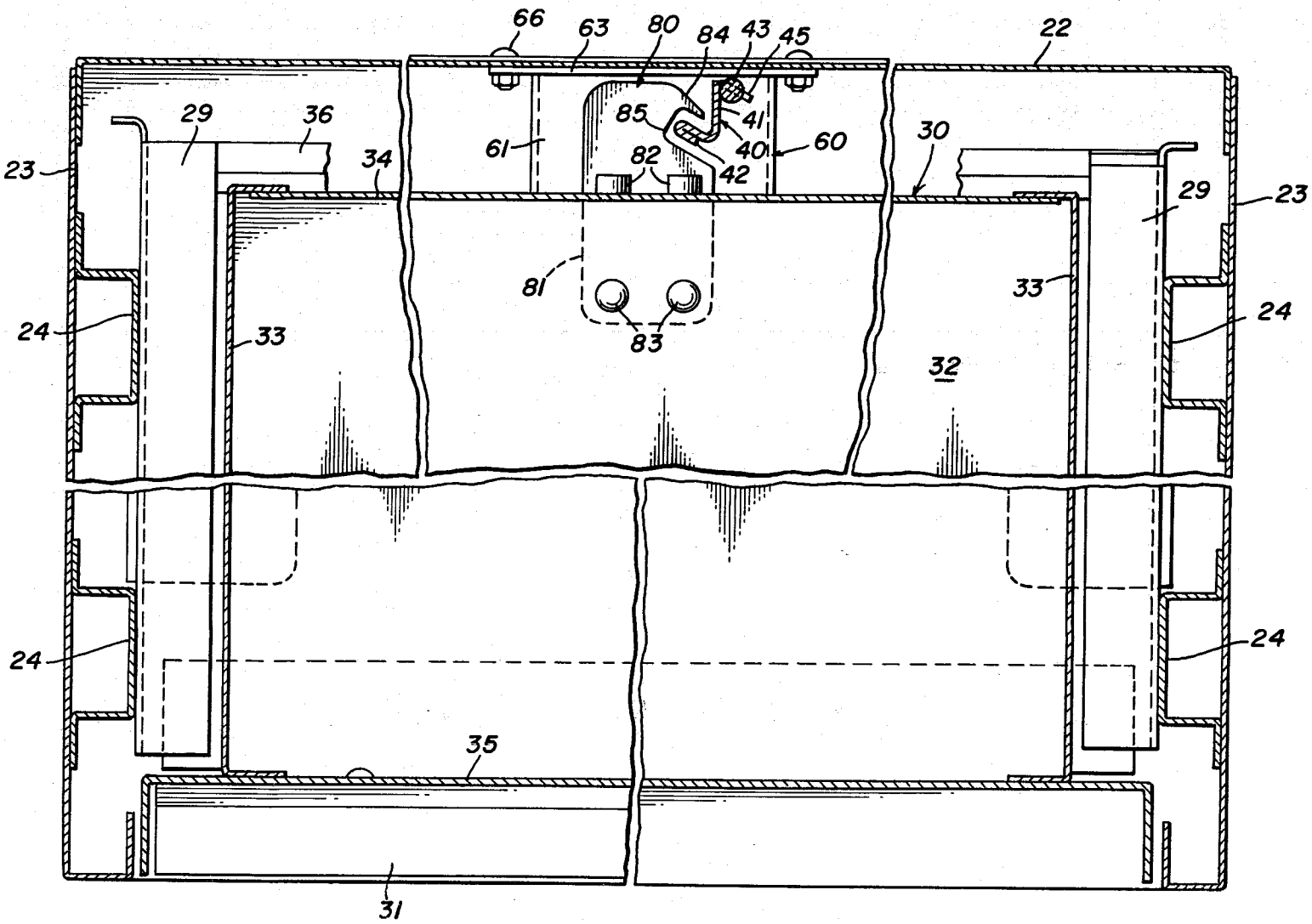
FIG. 3 is a fragmentary view in horizontal cross section taken along the line 3—3 of FIG. 2.

Referring now to FIGS. 2 and 3, further details of the cabinet 20 and the drawers 30 will be described. Attached to the inside surface of each of the side walls 23 is a set of longitudinally extending, vertically spaced apart channel members 24. Attached to the inside surface of the top 25 are longitudinally extending, horizontally spaced apart channel members 26. Attached to the inside surface of the base 27 are longitudinally extending, horizontally spaced apart channel members 28. For each drawer 30, there is provided a pair of longitudinally extending, parallel cabinet rails 29 respectively fixedly attached to the channel members 24. As will be described, the cabinet rails 29 provide the means by which each drawer 30 is suspended.

Each drawer 30 has a bottom wall 32 that is generally rectangular in shape and has a width slightly less than the inner width of the cabinet case 21 and a length slightly less than that of the cabinet case 21, the longitudinally extending inner edges of the bottom wall 32 carrying side walls 33. The rear end of the drawer 30 is closed by a rear wall 34. Each drawer 30 rests upon a carrier assembly 36, the details of which are not particularly important to the present invention. Suffice it to say, that the carrier assembly 36 carries rollers (not shown) which are located within the cabinet rails 29. The drawer 30 in turn carries rollers (not shown) which rest on the carrier assembly 36. Thus, a three-element suspension assembly is provided: the cabinet rails 29, the carrier assembly 36, and the drawers 30.

The drawer locking system according to the present invention includes several elements the first of which is a latching bar 40. Reference will be made particularly to FIGS. 2, 6 and 9 to describe the same. The latching bar 40 includes a vertically extending main wall 41. At the front of such main wall 41 is a flange 42 which is folded over upon itself and forms an acute angle with the main wall 41. In an operative embodiment, the acute angle between the main wall 41 and folded over portion 42 was 50°. The latching bar 40 further includes a pair of coaxial pins 43 located adjacent to the rear of the main wall 41 respectively at the upper and lower ends thereof. The pins 43 are welded to the main wall 41. Between the pins 43 there is provided a reinforcing flange 45, being a continuation of the main wall 41. As is best seen in FIG. 9 the metal forming the latching bar 40 is only partially folded at the upper end thereof, thereby forming an attachment flange 46 having holes 47 and 48 therein.

Figure 4:
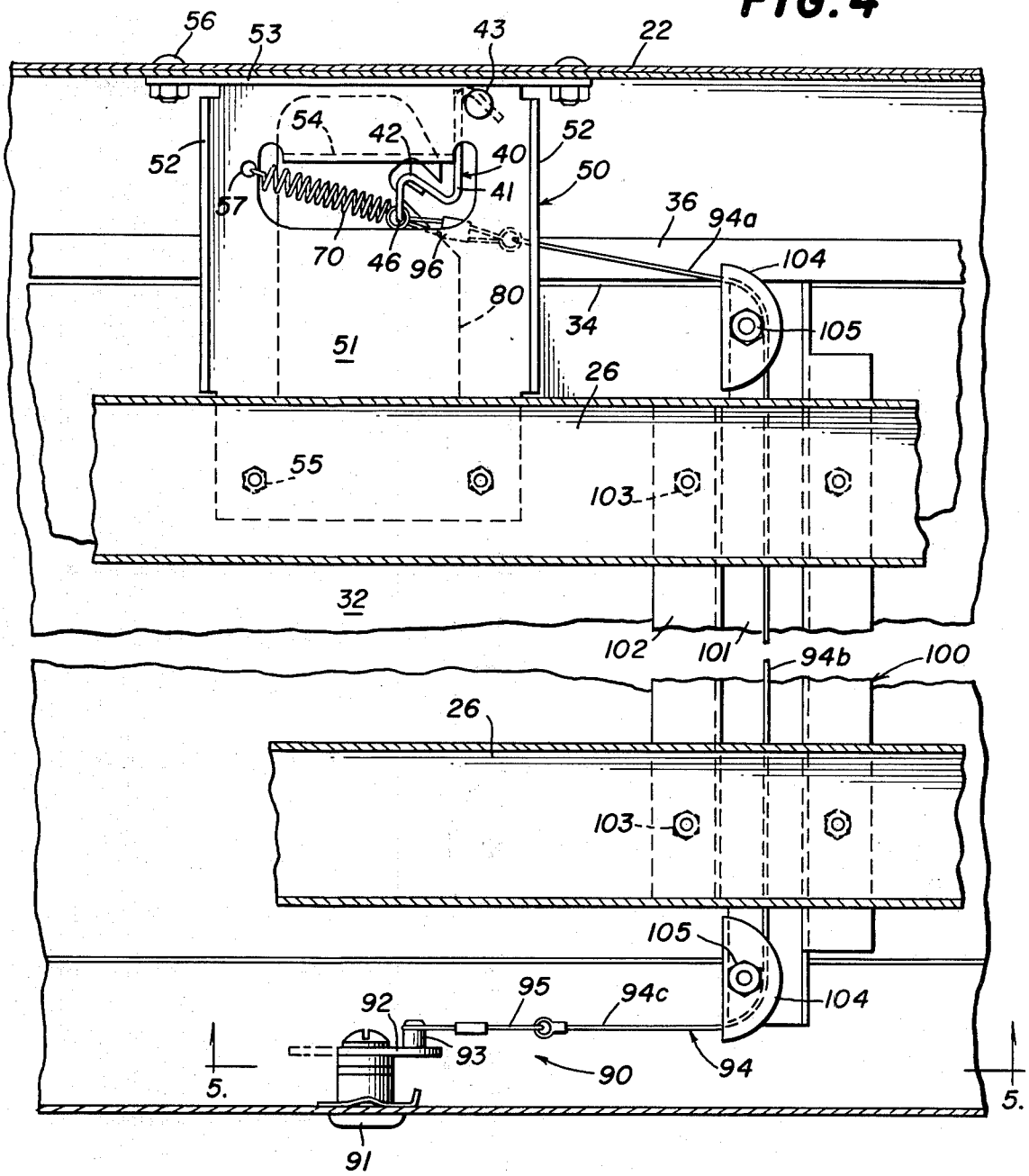
FIG. 4 is a fragmentary view in horizontal section taken along the line 4—4 of FIG. 2.

The drawer locking system includes attachment members 50 and 60 for mounting the latching bar 40. Referring to FIGS. 2, 4 and 6, the attachment member 50 includes a main wall 51, a pair of depending side walls 52 along the sides thereof and a rear depending flange 53 at the rear thereof. A U-shaped slit is formed in the main wall 51 and the tab remaining is bent to form an upstanding flange 54. The attachment member 50 is attached to the channel members 26 by means of fasteners 55 and is attached to the rear wall 22 by means of fasteners 56 passing therethrough and through the rear flange 53.

The attachment member 60 has basically the same construction, including a main wall 61, a pair of depending side walls 62 along the sides thereof and a rear depending flange 63 at the rear thereof. A U-shaped slit is formed in the main wall 61 and the tab remaining is bent to form an upstanding flange 64. The attachment member 60 is attached to the channel members 28 by means of fasteners 65 and is attached to the rear wall 22 by means of fasteners 66 passing therethrough and through the rear flange 63.

The upper pin 43 on the latching bar 40 extends through a complementary hole (not shown) in the main wall 51 of the attachment member 50. Similarly, the lower pin 43 extends through a complementary hole in the main wall 51 of the attachment member 60. A nylon spacer member 67 surrounds the lower pin 43 and is located between the lower end of the main wall 41 and the main wall 61. The elongated latching bar 40 may be said to have a longitudinal axis defined by the pins 43, which axis is substantially perpendicular to both the top 25 and the base 27 of the cabinet 20. The latching bar 40 is rotatable about such longitudinal axis.

The drawer locking system further includes a tension spring 70 having one end in the hole 57 of the attachment member 50 and the other end in the hole 47 of the attachment flange 46 of the latching bar 40. The spring 70 biases the latching bar in a clockwise direction, as viewed in FIG. 4. The surface of the upstanding flange 54 to the right, as viewed in FIG. 4, constitutes a stop engaged by the surface of the main wall 41, thereby to limit the extent of clockwise rotation of the latching bar 40. The right-hand (as viewed in FIG. 6) surface (not shown) of the upstanding flange 64 on the lower attachment member 60 also defines a stop which is engaged by the main wall 41.

The drawer locking system further comprises a latching clip 80, the details of which are best seen in FIGS. 3 and 6. The latching clip 80 is platelike and has a generally rectangular shape. Its front half defines an attachment portion 81 secured to the underside of the associated drawer 30 by means of fasteners 83. The clip 80 has a pair of laterally spaced apart bosses 82 which are simply sheared from the metal body of the clip 80. These bosses 82 butt up against the rear end of the rear wall 34 of the drawer 30 as is best seen in FIG. 2. The bosses 82 in combination with the fasteners 83 fixedly attach the latching clip 80 to the drawer 30 and prevent rotation thereof. The latching clip 80 is preferably mounted at a point centered with respect to the side walls 33 of the drawer 30. Formed on the rear of the clip 80 on one side thereof is a camming surface 84 which is inclined rearwardly and toward one of the side walls. In an operative embodiment, the acute angle between the longitudinal axis front to back of the cabinet, and the camming surface 84 was 30°. When the latching clip 80 is mounted approximately in the center of the drawer 30, its camming surface 84 will be aligned with the folded-over flange 42 of the latching bar 40 as will be described. The latching clip 80 further has a keeper slot 85 opening toward one side thereof and extending rearwardly and towards the other side thereof.

The manner in which the latching bar 40 and the latching clip 80 co-act is best seen in FIGS. 7 and 8. As shown in FIG. 7, the latching bar 40 is in its latching position, that is, it is rotated as far as possible in a clockwise direction and is limited by the stop surfaces on the upstanding flanges 54 and 64. The camming surface 84 of the latching clip 80 is aligned with the folded-over flange 42 of the latching bar 40. As the drawer 30 is pushed toward the closed position thereof, the camming surface 84 engages the folded-over flange 42. Continued rearward pushing of the drawer 30 causes the latching bar 40 to rotate counterclockwise as shown in FIG. 8. When the camming surface 84 is moved it causes rotation of the latching bar 40 to a point where the tip of the folded-over flange 42 clears the latching clip 80, whereupon the latching bar 40 will be in its unlatching position. Continued pushing of the drawer 30 to its closed position causes the folded-over flange 42 to become aligned with the keeper slot 85. The spring 70 snaps the folded-over flange 42 into the keeper slot 85, whereupon the latching bar 40 has reverted to its latching position. The drawer 30 cannot be withdrawn unless and until the latching bar 40 is placed in its unlatching position. The device for performing this function is the release mechanism 90 which is best shown in FIGS. 4, 5 and 6.

The release mechanism 90 includes the usual tumbler lock 91 in which the tumbler is rotatable only when a key of the correct configuration is inserted into the slot. The tumbler is attached to a finger 92 which carries a lug 93. A cable 94 has one end attached to the lug 93 by means of a connector 95 and the other end connected to the latching bar 40 by means of a connector 97, and specifically into the hole 48 (FIG. 9) of the attachment flange 46. Each of the connectors 95 is simply a wire bent as shown with its ends spaced apart, and a sleeve to hold the cable in place. A cable cover 100 includes a longitudinally extending channel 101 and a pair of attachment flanges 102. As is best seen in FIG. 2, the attachment flanges 102 are secured to the channel members 26 by means of fasteners 103. At each end of the channel 101 is a nylon cable guide 104 which is semicircular in outline. As is best seen in FIG. 5, each cable guide 104 has a semicircular track 106 and a pair of confining lips 107. The cable 94 extends along about 90° of the track 96 in the cable guide 104 at the rear and also 90° of the track 106 in the cable guide 104 at the front. The cable guides are mounted to the channel 101 by means of fasteners 105. The lips 107 insure that the cable 94 remains on the associated track. The two cable guides 104 divide the cable into three flights 94*a*, 94*b* and 94*c*. The flight 94*a* is generally coaxial with the biasing direction of the spring 70, as best seen in FIG. 4, so that outward pulling on the flight 94*a* causes counterclockwise rotation of the latching bar 40 against the action of the spring 70. The second flight 94*b* extends generally parallel to the side walls 23 of the cabinet 20. The third flight 94*c* is generally perpendicular to the flight 94*b*.

Figure 5:
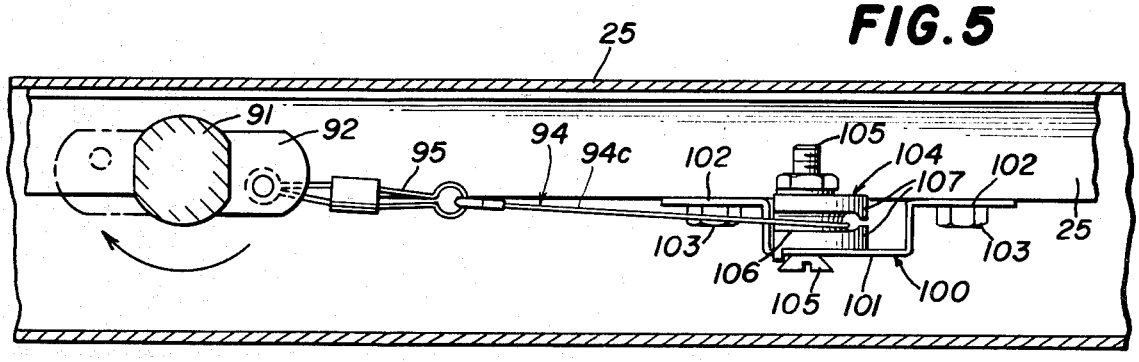
FIG. 5 is a fragmentary view on an enlarged scale taken along the line 5—5 of FIG. 4.

In FIGS. 4, 5 and 6, the lock 91 is shown in its locking position; in other words the finger 92, shown in solid line, is directed to the right. In that condition, tension on the cable 94 is at a minimum, the spring 70 is holding the latching bar 40 in its latching position and all of the drawers 30 theretofore closed cannot be opened. Insertion of a key into the lock 91 and rotating the tumbler therein will cause the finger 92 to move to the phantom-line position, whereupon the cable 94 is tensed and the latching bar 40 is rotated to its unlatching position; i.e. the folded-over flange 42 is withdrawn from the keeper slots 85 of the latching clip 80 on each of the eleven drawers 30. Now, any such drawers can be opened.

If it is desired to maintain access to a selected drawer, that drawer can remain open. The lock 91 can be moved to its locking position, as shown in solid line in FIGS. 4–6. The folded-over flange 42 of the latching bar 40 is caused to enter the keeper slot 85 of each of the remaining ten drawers 30. After one has completed his use of the one drawer, he can close the same and automatically cause it to become locked and closed. While open, the latching clip 80 relative to the latching bar 40 will be as shown in FIG. 7. When he closes it, as previously described, the latching bar 40 will be rotated counterclockwise by the camming surface 84 until the drawer becomes locked once again. While this example was described with respect to ten closed drawers and one open drawer, it may be appreciated that any number of the drawers can be left open and the rest locked. Those open drawers can be examined as desired and then closed one at a time and automatically locked.

The drawer locking system of the present invention has been described in the context of a cabinet. However, it is to be understood that the system can be employed in other environments such as a shelving system. There are instances where drawers on shelves need to be locked and unlocked in the manner achieved by the present invention.

What has been described is a drawer locking system which can be locked while one or more of drawers 30 is still open. As each drawer 30 is closed, it becomes automatically locked and closed. Such prelocking eliminates possible damage to the entire drawer locking system caused when the cabinet is unintentionally locked with one or more of the drawers open. Without the present invention, trying to close those drawers could damage the locking system.

A very important feature of the invention is its ability to accommodate drawers of a variety of heights. In the embodiment described above, there are eleven drawers in the cabinet of a few different heights. The same cabinet could accommodate a lesser number of drawers where all or some are of greater height than the drawers shown. With the present invention, no modification of the locking system is necessary. A latching clip 80 applied to the rear of each drawer 30 is all that is necessary since the latching bar 40 is continuous. Of course, the locations of the cabinet rail 29 would have to be modified.

I claim:

1. A drawer locking system for use with a frame having a front, a rear, a pair of sides and upper and lower ends, and at least two drawers carried by the frame and movable between a forwardly open position and a rearwardly closed position, said drawer locking system comprising an elongated latching bar having a longitudinal axis substantially perpendicular to the ends of the frame and extending adjacent to the drawers, said latching bar being rotatable about said longitudinal axis between latching and unlatching positions, means for biasing said latching bar to the latching position thereof, and a latching clip on each of said drawers and having camming means for engaging said latching bar and causing rotation thereof to the unlatching position thereof as the associated drawer is moved toward the closed position thereof, whereupon the associated drawer can be moved further toward the closed position until said camming means passes said latching bar, whereupon said latching bar tends toward the latching position thereof, said latching clip further having keeper means for receiving said latching bar as it rotates toward the latching position thereof.

2. The drawer locking system of claim 1, wherein said latching bar has a generally vertically extending main wall and a folded-over flange on the front of said main wall at an acute angle with respect thereto, said folded-over flange fitting into said keeper means when said latching bar is in the latching position thereof.

3. The drawer locking system of claim 1, wherein said latching bar includes a generally vertically extending main wall and two coaxial pins adjacent to the rear of the main wall respectively at the upper and lower ends thereof, said pins being rotatably carried by the frame.

4. The drawer locking system of claim 3, wherein said pins are welded to said main wall.

5. The drawer locking system of claim 1, wherein said latching bar includes a main wall and a flange at the rear thereof at an acute angle with respect thereto, and two coaxial pins aligned with said rear flange and extending in opposite directions therefrom, said pins being rotatably carried by the frame.

6. The drawer locking system of claim 1, wherein said biasing means is a spring.

7. The drawer locking system of claim 1, wherein said latching clip is adjacent to the rear end of each of the drawers, and said latching bar is located to the rear of the drawers when in the closed positions thereof.

8. The drawer locking system of claim 1, wherein said latching clip is plate-like.

9. The drawer locking system of claim 1, wherein said latching clip is plate-like and has an attachment portion attached to the underside of the associated drawer at the rear end thereof and has a pair of laterally spaced-apart bosses contacting the rear end of the associated drawer, said latching bar being located to the rear of the drawers in the closed positions thereof.

10. The drawer locking system of claim 1, wherein said latching clip is centered with respect to the sides of the associated drawer.

11. The drawer locking system of claim 1, wherein said keeper means is a slot extending rearwardly and towards one of the sides of the frame.

12. The drawer locking system of claim 11, wherein said camming means is an inclined surface adjacent to said slot.

13. A drawer locking system for use with a frame having sides, a front, a rear, and upper and lower ends, and at least two drawers carried by the frame and movable between a forwardly open position and a rearwardly closed position, said drawer locking system comprising a first attachment member mounted to the frame adjacent the upper end thereof, a second attachment member mounted to the frame adjacent the lower end thereof, an elongated latching bar having a longitudinal axis substantially perpendicular to the ends of the frame and extending adjacent to the drawers, said latching bar having an upper pin rotatably engaging said first attachment member, said latching bar having a lower pin rotatably engaging said second attachment member, said latching bar being rotatable about said longitudinal axis between latching and unlatching positions, means for biasing said latching bar to the latching position thereof, and a latching clip on each of said drawers and having camming means for engaging said latching bar and causing rotation thereof to the unlatching position thereof as the associated drawer is moved toward the closed position thereof, whereupon the associated drawer can be moved further toward the closed position until said camming means passes said latching bar, whereupon said latching bar tends toward the latching position thereof, said latching clip further having keeper means for receiving said latching bar as it rotates toward the latching position thereof.

14. The drawer locking system of claim 13, wherein said biasing means is a spring connected between one of said attachment members and said latching bar.

15. The drawer locking system of claim 13, wherein at least one of said attachment members has stop means for limiting the extent of rotation of said latching bar caused by said biasing means.

16. The drawer locking system of claim 13, wherein said latching bar includes a spacer ring surrounding said lower pin and being disposed between said main wall and said lower attachment member.

17. The drawer locking system of claim 13, wherein said first and second attachment members are identical.

18. A drawer locking system for use with a frame having a front, a rear, a pair of sides, and upper and lower ends, and at least two drawers carried by the frame and being movable between a forwardly open position and a rearwardly closed position, said drawer locking system comprising an elongated latching bar having a longitudinal axis substantially perpendicular to the ends of the frame and extending adjacent to the drawer, said latching bar being rotatable about said longitudinal axis between latching and unlatching positions, means for biasing said latching bar to the latching position thereof, a latching clip on each of said drawers and each having camming means for engaging said latching bar and causing rotation thereof to the unlatching position thereof as the associated drawer is moved toward the closed position thereof, whereupon the associated drawer can be moved further toward the closed position until said camming means passes said latching bar, whereupon said latching bar tends toward the latching position thereof, said latching clip having keeper means for receiving said latching bar as it rotates toward the latching position thereof, and release means for manually rotating said latching bar to the unlatching position thereof to enable any one of the drawers to be moved to the open position thereof.

19. The drawer locking system of claim 18, wherein said release means includes a key-operated lock movable between locking and unlocking positions, and a cable having one end attached to said latching bar and another end attached to said lock, operation of said lock to the unlocking position thereof causing rotation of said latching bar to the unlatching position thereof against the action of said biasing means, operation of said lock to the locking position thereof permitting said latching bar to be pulled to its latching position by said biasing means.

20. The drawer locking system of claim 19, wherein said biasing means is a spring biasing said latching bar in a predetermined direction toward one side of the frame and rearwardly, said cable having a first flight generally coaxial with said predetermined direction and having its free end attached to said latching bar, and having a second flight generally parallel to the sides of the frame and having a free end coupled to said lock, said release means including a cable guide at the juncture of said first and second flights.

21. The drawer locking system of claim 20, wherein said lock is mounted to the front of the frame to one side of said second flight, said cable having a third flight being a continuation of said second flight and having a free end attached to said lock, said release means including a further cable guide at the juncture of said second and third flights.

22. The drawer locking system of claim 20, wherein said release means further includes a channel attached to the frame and containing said second flight.

23. The drawer locking system of claim 20, and further comprising at least one cable guide for changing the direction of said cable, said cable guide having an arcuate track and means for maintaining said cable on said track.

24. In a cabinet having a front, a rear, a pair of side walls, an upper wall, and a base and at least two drawers in the cabinet and between a forwardly open position and a rearwardly closed position, a drawer locking system comprising an elongated latching bar having a longitudinal axis substantially perpendicular to the ends of the upper wall and extending adjacent to the drawers, said latching bar being rotatable about said longitudinal axis between latching and unlatching positions, means for biasing said latching bar to the latching position thereof, and a latching clip on each of said drawers and having camming means for engaging said latching bar and causing rotation thereof to the unlatching position thereof as the associated drawer is moved toward the closed position thereof, whereupon the associated drawer can be moved further toward the closed position until said camming means passes said latching bar, whereupon said latching bar tends toward the latching position thereof, said latching clip further having keeper means for receiving said latching bar as it rotates toward the latching position thereof.

* * * * *